US008402915B2

(12) United States Patent
Chen

(10) Patent No.: US 8,402,915 B2
(45) Date of Patent: Mar. 26, 2013

(54) COMPOSITE COATING APPARATUS INCLUDING Q-SWITCH LASER SOURCE

(75) Inventor: Hsiang-Hung Chen, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 651 days.

(21) Appl. No.: 12/693,505

(22) Filed: Jan. 26, 2010

(65) Prior Publication Data

US 2010/0264020 A1 Oct. 21, 2010

(30) Foreign Application Priority Data

Apr. 20, 2009 (CN) ..... 2009 1 0301676

(51) Int. Cl.
*B05C 3/00* (2006.01)
*C25B 9/00* (2006.01)

(52) U.S. Cl. ..... 118/429; 204/242

(58) Field of Classification Search ..... None
See application file for complete search history.

(56) References Cited

U.S. PATENT DOCUMENTS

| | | | | |
|---|---|---|---|---|
| 3,810,829 | A * | 5/1974 | Fletcher | 204/222 |
| 4,367,123 | A * | 1/1983 | Beck | 205/129 |
| 4,511,595 | A * | 4/1985 | Inoue | 427/581 |
| 4,578,157 | A * | 3/1986 | Halliwell et al. | 205/86 |
| 5,292,418 | A * | 3/1994 | Morita et al. | 204/224 R |
| 2002/0125141 | A1 * | 9/2002 | Wilson et al. | 205/96 |

* cited by examiner

*Primary Examiner* — Dah-Wei Yuan
*Assistant Examiner* — Charles Capozzi
(74) *Attorney, Agent, or Firm* — Altis Law Group, Inc.

(57) ABSTRACT

A composite coating apparatus includes a first device configured for forming a nanoscale metal particle layer on an electrically conductive workpiece and a second device configured for forming metallic film on the nanoscale metal particles. The first device includes a Q-switch laser source for providing impulse laser light beams, a first liquid-ejecting member configured for ejecting electrolyte liquid contained therein onto the workpiece, and a first hollow light guide conduit for guiding the impulse laser light beams through the first liquid-ejecting member onto the workpiece. As such, an electrochemical reaction occurs on the workpiece. The electrolyte liquid forms a metal film and is then vibrated into nanoscale particles by the impulse laser light beams.

11 Claims, 3 Drawing Sheets

COMPOSITE COATING APPARATUS INCLUDING Q-SWITCH LASER SOURCE

BACKGROUND

1. Technical Field

The present disclosure relates to composite coating, and more particularly, to a composite coating apparatus including a Q-switch laser source.

2. Description of Related Art

Surface coatings are widely used to protect the surface of workpieces. The surface coating process generally includes manufacturing metal nanoscale particles, adding the nanoscale particles into a plating liquid to obtain a mixture, and depositing the mixture on the workpiece surface by electrochemical or chemical deposition. According to commonly used technology, a first apparatus is required for manufacturing the nanoscale particles, a second apparatus is required for mixing the nanoscale particles and the plating liquid, and a third apparatus is required for depositing the mixture on the surface of the workpiece. Costs are correspondingly high. Furthermore, due to high energy, the nanoscale particles easily attract one other in the plating mixture and are difficult to uniformly disperse. The resultant concentration variations degrade uniformity of surface properties.

Therefore, what is called for is a composite coating apparatus overcoming the limitations described.

BRIEF DESCRIPTION OF THE DRAWINGS

Many aspects of the composite coating apparatus can be better understood with reference to the following drawings. The components in the drawings are not necessarily drawn to scale, the emphasis instead being placed upon clearly illustrating the principles of embodiments of the composite coating apparatus. Moreover, in the drawings, all the views are schematic, and like reference numerals designate corresponding parts throughout the different views.

DETAILED DESCRIPTION

Figure 1:
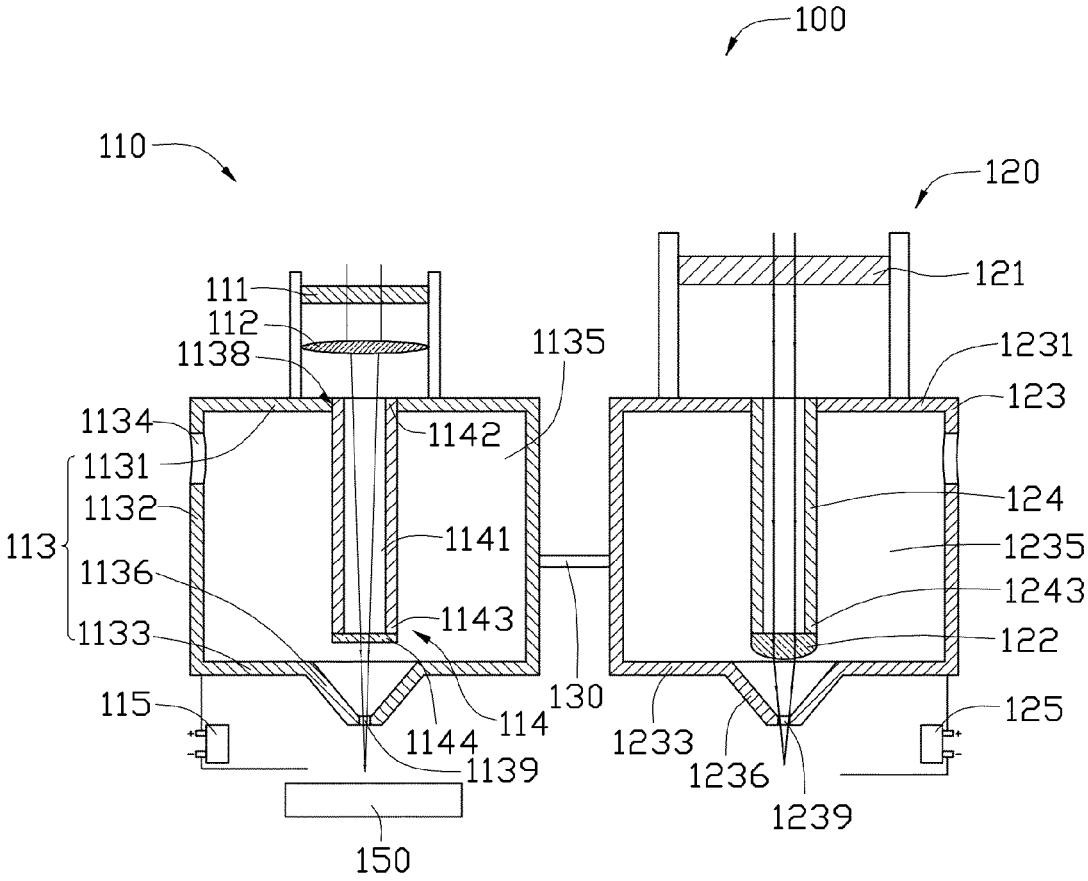
FIG. 1 is an isometric, sectional view of a composite coating apparatus, according to an exemplary embodiment of present invention.
Figure 2:
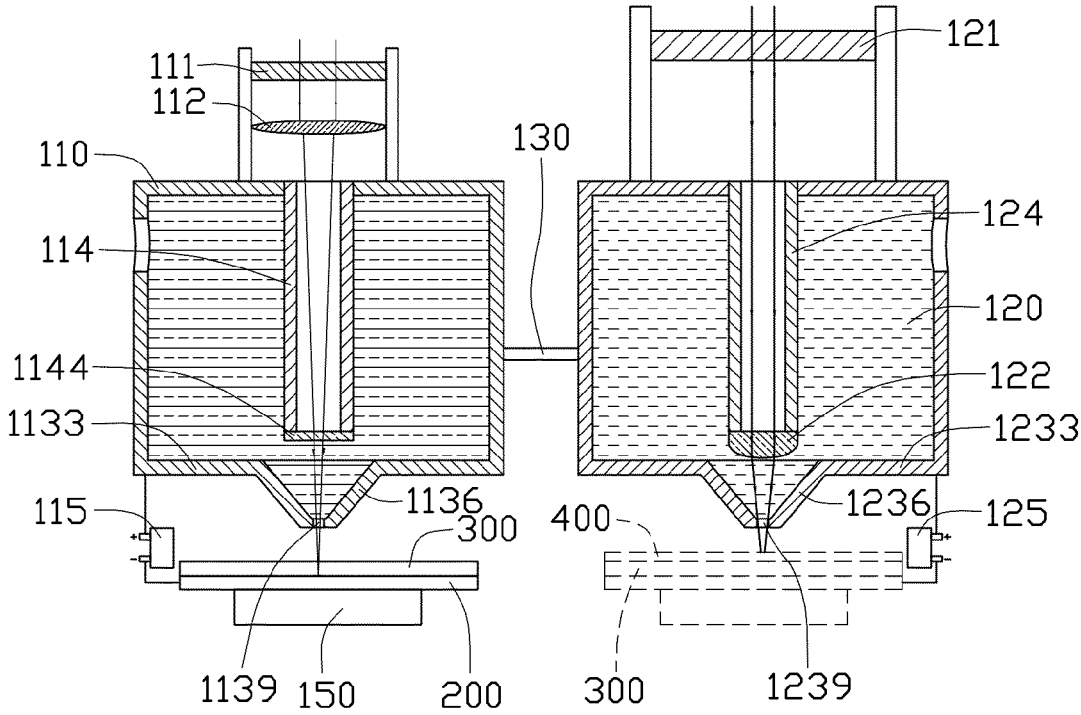
FIG. 2 shows formation of a composite coating on a surface of an electrically conductive workpiece using the apparatus of FIG. 1.

Referring to FIGS. 1 and 2, a composite coating apparatus 100 is provided in an exemplary embodiment. The apparatus 100 includes a first device 110 configured for forming nanoscale metal particles on an electrically conductive workpiece, a second device 120 configured for forming metallic film on the nanoscale metal particles, a connecting member 130, and a supporting device 150 for supporting a workpiece 200. The first device 110, the second devices 110, 120 and the connecting member 130 are capable of moving horizontally along the supporting device 150.

The first device 110 includes a first liquid-ejecting member 113, a first light guide conduit 114, a first power source 115, a Q-switch laser source 111, and a first converging lens 112. The first device 110 coats the workpiece 200 by ejecting electrolyte liquid thereonto.

The first liquid-ejecting member 113 has a first top wall 1131, a first sidewall 1132, a first electrically conductive bottom wall 1133 opposite to the first top wall 1131, and a first nozzle 1136. The first top wall 1131, the first sidewall 1132 and the first bottom wall 1133 cooperatively define a first chamber 1135 accommodating electrolyte liquid. The top wall 1131 defines a first light incident through hole 1138 in the center thereof. The first light incident through hole 1138 communicates with the first chamber 1135. The first sidewall 1132 has an inlet 1134 communicating with the first chamber 1135 and a tank (not shown) filled with the electrolyte liquid. As such, the electrolyte liquid can be introduced into the first chamber 1135 from the tank through the inlet 1134. The first electrically conductive bottom wall 1133 is copper. The first nozzle 1136 extends outward from the first electrically conductive bottom wall 1133, and has a first liquid-ejecting though hole 1139 aligned with the first light incident through hole 1138.

It is noted that the first electrically conductive bottom wall 1133 can be other electrically conductive metal, such as iron or aluminum. The inlet 1134 can alternatively be defined in the first top wall 1131.

The first light guide conduit 114, accommodated in the first chamber 1135, is shorter than a distance between the first top wall 1131 and the first electrically conductive bottom wall 1133. The first light guide conduit 114 includes a first end 1142 and a second end 1143. The first end 1142 is open and fixed in the first light incident through hole 1138. The second end 1144 is spaced from the first liquid-ejecting through hole 1139. The first light guide conduit 114 absorbs little laser light beams and has superior strength. In the present embodiment, the first light guide conduit 114 is polymethylmethacrylate. A transparent plate 1144 is sealed to an end surface of the second end 1143 to prevent electrolyte liquid from entering the first light guide conduit 114. The transparent plate 1144 may be glass.

The anode of the first power source 115 electrically connects with the first bottom wall 1133, and the cathode of the first power source 111 electrically connects with the workpiece to be coated. When the electrolyte liquid is continuously applied onto the workpiece, the electrolyte liquid electrically connects the first bottom 1133, and a corresponding electrical field is produced between the first bottom wall 1133 and the workpiece. If the Q-switch laser source is shut off, and electrolyte liquid applied onto the workpiece, the voltage value of the first power is insufficient for electrochemical reaction on both the first electrically conductive bottom 115 and the workpiece. In the present embodiment, the first power source 115 provides 0.825V between the first electrically conductive bottom wall 1133 and the workpiece.

The Q-switch laser source 111 is located over the first liquid-ejecting device 113, providing Nd-YAG impulse laser of 1064 nm wavelength. In the present embodiment, the Q-switch laser source 111 is a Lee laser series 800 Nd-YAG Q-switch generator. The first converging lens 112 is located between the Q-switch laser source 111 and the first liquid-ejecting device 113, converging and directing the impulse laser emitted from the Q-switch laser source 111 into the light guide chamber 1141 of the first light guide conduit 114 and then passing through the first liquid ejecting through hole 1139. The first converging lens 112 is coaxial with the first light guide conduit 114.

The second device 120 includes a second liquid-ejecting member 123, a second light guide conduit 124, a second power source 125, a continuous laser source 121 and a second converging lens 122. The second device 120 has similar structure with the first device 110 except that the second converging lens 122 is fixed on an second end 1243 of the second light guide conduit 124. The converging lens 122 is spaced from a second liquid-ejecting through hole 1239. An optical axis of the second converging lens 122 is coaxial with the central axis of the second light guide conduit 124 and that of a second liquid-ejecting through hole 1239. The continuous laser source 121 provides Nd-YAG continuous laser of 1064 nm wavelength. In the present embodiment, the continuous laser source 121 is a Lee laser series 800 Nd-YAG continuous laser generator. The second electrically conductive bottom wall 1233 is iron, and can be electrically connected with the anode of the second power source 125. If the electrolyte liquid contained in the second device 120 is continuously applied onto the workpiece, and the second electrically conductive bottom wall 1233 and the workpiece are electrically connected to each other via the electrolyte liquid therebetween, an electrical field is produced between the second electrically conductive bottom wall 1233 and the workpiece. If the continuous laser source 121 is shut off and the second electrically conductive bottom 125 and the workpiece are connected to each other with electrolyte liquid, the voltage value of the second power source 115 is insufficient for electrochemical reaction occurring between the second electrically conductive bottom 125 and the workpiece. In the present embodiment, the second power source 125 provides 0.825V between the second electrically conductive bottom wall 1233 and the workpiece.

Description of an exemplary operation of the apparatus in which a composite coating including copper nanoscale particles and iron film is formed follows.

Figure 3:
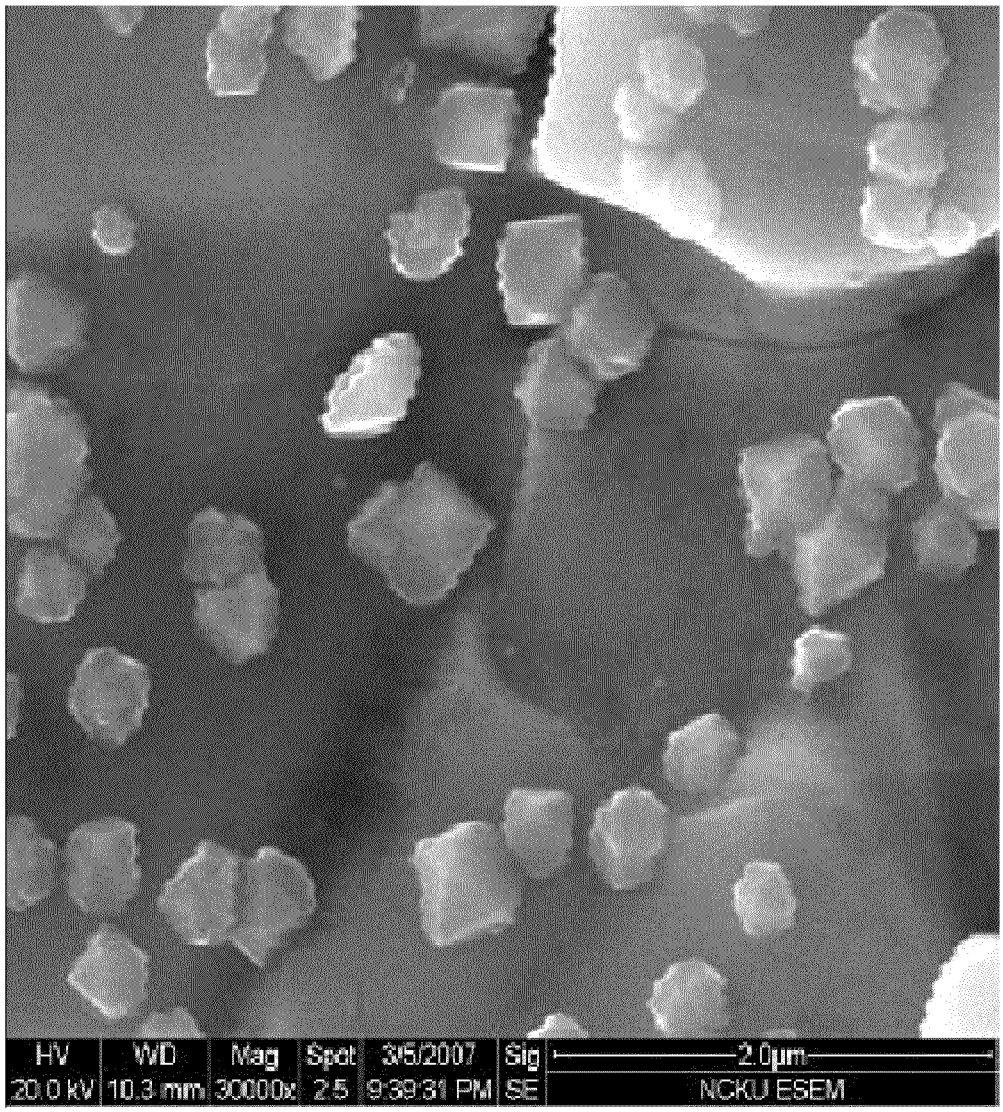
FIG. 3 shows a scanning electrical microscope (SEM) micrograph of the composite coating of FIG. 1.

In detail, referring to FIGS. 2 and 3, the first liquid-ejecting device 110 is completely filled with $CuSO_4$ solution, and the second liquid-ejecting device 120 with $Fe_2(SO_4)_3$ solution. The concentrations of the $CuSO_4$ solution and the $Fe_2(SO_4)_3$ solution are such that when the electrical field is respectively produced between the first electrically conductive bottom wall 1133 and the workpiece, and the second electrically conductive bottom wall 1233 and the workpiece, when the Q-switch laser source 111 and the continuous laser source 121 are shut off, no electrochemical reaction occurs on the first electrically conductive bottom 1133, the second electrically conductive bottom 1233 and the workpiece. In the present embodiment, the second power source 125 provides 0.825V between the second electrically conductive bottom wall 1233 and the workpiece, and concentrations of the $CuSO_4$ solution and $Fe_2(SO_4)_3$ solution are 0.05 mol/L.

The Q-switch laser source 111 is turned on and the first nozzle 1136 ejects the $CuSO_4$ solution onto the workpiece 200 controlled by a flowmeter. Impulse laser lights emitted from the Q-switch laser source 111 are focused by the first converging lens 112 into the first light guide conduit 114, directed inside the first nozzle 1136, and pass through the first liquid ejecting through hole 1139 onto the workpiece 200. Thereafter, a first incident region corresponding to the first liquid ejecting through hole 1139 is illuminated by the impulse laser lights. Accordingly, as the considerable energy of the impulse laser light beams is received, temperature of the first incident region increases, until, upon reaching a predetermined value, electrochemical reaction respectively occurs on the first electrically conductive bottom 1133 and the workpiece 200. That is, the first electrically conductive bottom 1133 loses electrons, $Cu^{2+}$ is produced and enters the $CuSO_4$ solution, the $Cu^{2+}$ contained in the original $CuSO_4$ solution attracts the electrons, and rises from the first electrically conductive bottom 1133 to the first incident region of the workpiece 200, resulting in formation of a copper film at the first incident region.

The impulse laser beams emitted to the first incident region generate ultrasonic vibration. As a result, the copper film is vibrated into a plurality of copper particles. When the electrolyte liquid is continuously applied onto the workpiece 200, an impulse force is generated and applied to the copper particles on the workpiece 200, and then the copper particles are moved away from the incident region to other region of the surface of the workpiece. The copper particles stop growing as soon as they leave the incident region, such that diameter of the copper particles can remain nanoscale.

When the first device 110 is moved over the workpiece 200, the entire surface of the workpiece 200 opposite to the first nozzle 1136 is coated with a nanoscale particle layer 300. In the present embodiment, radiant power of the Q-switch laser source 111 is 5 W, flow rate of the electrolyte liquid is 1 L/min, and an illumination time of the impulse laser on the workpiece 3 minutes.

The workpiece 200 having the copper particles formed thereon is electrically connected with the cathode of the second power source 125, and the second electrically conductive bottom wall 1233 is electrically connected with the anode of the second power source 125. The continuous laser source 121 is operated, and the $Fe_2(SO_4)_3$ solution is continuously applied onto the workpiece 200, thereby obtaining an iron film 400 on the copper particle layer 300. The continuous laser beams emitted from the continuous laser source 121 converge and into the second light guide conduit 124, passing through the second liquid ejecting through hole 1239, and continuing to the surface of the workpiece 200. The continuous laser beams form a second incident region corresponding to the second liquid ejecting through hole 1239 on the workpiece 200. As a result, considerable energy is produced in the second incident region, and the temperature of the workpiece is increased, until, upon reaching a predetermined value, an electrochemical reaction respectively occurs in the second electrically conductive bottom 1233 and the workpiece 200. Therefore, an iron film is formed in the second incident region. When the second device 120 is driven parallel to the workpiece 200, the workpiece 200 is coated with an iron film, thereby obtaining a composite coating having nanoscale copper particles layer 300 and iron film layer 400. In the present embodiment, a radiant power of the continuous laser source 121 is 5 W, a volume flow rate of the $Fe_2(SO_4)_3$ solution is 1 L/minute, and the incident time is 3 minutes. The workpiece 200 coated with a composite coating including copper nanoscale particles and iron film is tested using a scanning electronic microscope having 20KV voltage with 30 thousands magnification. Referring to FIG. 3, the test result shows that diameter of the copper particles is in a range from 90 nm to 207 nm.

It is noted that the first device 110 and the second device 120 can work simultaneously, that is, the first device 110 and the second device 120 move together parallel to the workpiece in a predetermined direction, and then in an opposite direction. Accordingly, copper particles and iron film are alternatively formed on the workpiece 200.

It is also noted that the radiant power of the Q-switch laser source 111 and the continuous laser source 121, the voltage applied on the workpiece, the concentration of the electrolyte solutions, the volume flow rate, the incident time of the impulse laser light beams and the continuous laser light beams and the kind of the electrolyte liquid can be chosen according to actual need. For example, the radiant power of the Q-switch laser source 111 and the continuous laser source 121 can both be 2.5 W or 7.5 W, and flow rate of the electrolyte liquid 0.5 L/min In the present embodiment, the composite coating is formed based on electrochemical principles. The nanoscale copper particles and the iron film are formed alternatively.

Therefore, nanoscale copper particles disperse uniformly in the iron film and coverage is improved.

While certain embodiments have been described and exemplified above, various other embodiments will be apparent from the foregoing disclosure to those skilled in the art. The present disclosure is not limited to the particular embodiments described and exemplified but is memberable of considerable variation and modification without departure from the scope and spirit of the appended claims.

What is claimed is:

1. A composite coating apparatus, comprising:

a first device configured for forming nanoscale particles on an electrically conductive workpiece, comprising:

a Q-switch laser source configured for providing impulse laser light beams;

a first liquid-ejecting member comprising a first chamber for accommodating electrolyte liquid, a first light incident through hole, and a first electrically conductive bottom wall comprising a first liquid ejecting through hole, the first liquid ejecting through hole aligned with the first light incident through hole, the first liquid-ejecting member configured for ejecting the electrolyte liquid from the first chamber through the first liquid ejecting through hole; and a first hollow light guide conduit comprising a first end coupled with the first light incident through hole and a second end spaced from the first liquid ejecting through hole, configured for guiding the impulse laser light beams to the first liquid ejecting through hole; and a second device configured for forming a metallic film on the nanoscale particles, wherein the second device includes:

a continuous laser source for providing continuous laser light beams;

a second liquid-ejecting member comprising a second light incident through hole, a second chamber for accommodating electrolyte liquid, and a second electrically conductive bottom wall comprising a second liquid ejecting through hole, the second liquid ejecting through hole aligned with the second light incident through hole, the second liquid-ejecting member configured for ejecting the electrolyte liquid from the second chamber through the second liquid ejecting through hole; and a second hollow light guide conduit comprising a first end coupled with the second light incident through hole and a second end spaced from the second liquid ejecting through hole, configured for guiding the continuous laser light beams to the second liquid ejecting through hole.

2. The composite coating apparatus of claim 1, further comprising a first converging lens for converging and directing the impulse laser light beams to the first liquid ejecting through hole.

3. The composite coating apparatus of claim 2, wherein the first converging lens is located between the impulse laser source and the first light guide conduit.

4. The composite coating apparatus of claim 1, further comprising a transparent plate mounted to the second end of the first light guide conduit for preventing the electrolyte liquid from entering into the first light guide conduit.

5. The composite coating apparatus of claim 1, further comprising a second converging lens for converging and directing the continuous laser light beams to the second liquid ejecting through hole.

6. The composite coating apparatus of claim 5, wherein the second converging lens is mounted to the second end of the second light guide conduit, wherein the second converging lens is capable of preventing the electrolyte liquid from flowing into the second light guide conduit.

7. The composite coating apparatus of claim 1, further comprising a connecting member interconnected between the first device and the second device such that the first and second device move together.

8. The composite coating apparatus of claim 1, wherein the first device comprises a first nozzle extending outward from the first electrically conductive bottom wall, and the first liquid ejecting through hole is aligned with the first light incident through hole.

9. The composite coating apparatus of claim 1, wherein the second device comprises a second nozzle extending outward from the second electrically conductive bottom wall, and the second liquid ejecting through hole is aligned with the second light incident through hole.

10. The composite coating apparatus of claim 1, further comprising a first power source, an anode and a cathode of which respectively electrically connect with the first electrically conductive bottom wall and the workpiece.

11. The composite coating apparatus of claim 1, further comprising a second power source, an anode and a cathode of which are respectively electrically connect with the second electrically conductive bottom wall and the workpiece.

* * * * *